US006386462B1

(12) United States Patent
Martens, III

(10) Patent No.: US 6,386,462 B1
(45) Date of Patent: May 14, 2002

(54) METHOD AND APPARATUS FOR DISPENSING LIQUIDS IN AEROSOLIZED FORM WITH MINIMUM SPILLAGE

(75) Inventor: Edward J. Martens, III, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/629,603

(22) Filed: Jul. 31, 2000

(51) Int. Cl.[7] ..... B05B 17/04
(52) U.S. Cl. ..... 239/4; 239/102.2; 239/145
(58) Field of Search ..... 239/4, 102.1, 102.2, 239/145

(56) References Cited

U.S. PATENT DOCUMENTS

| | | | | |
|---|---|---|---|---|
| 4,628,040 A | | 12/1986 | Green et al. | |
| 4,790,479 A | | 12/1988 | Matsumoto et al. | |
| 4,793,339 A | | 12/1988 | Matsumoto et al. | |
| 5,139,016 A | | 8/1992 | Waser | |
| 5,164,740 A | | 11/1992 | Ivri | |
| 5,419,879 A | | 5/1995 | Vlahakis et al. | |
| 5,485,828 A | | 1/1996 | Hauser | |
| 5,518,179 A | | 5/1996 | Humbrerstone et al. | |
| 5,529,055 A | | 6/1996 | Gueret | |
| 5,575,992 A | | 11/1996 | Kunze | |
| 5,637,401 A | | 6/1997 | Berman et al. | |
| 5,647,052 A | | 7/1997 | Patel et al. | |
| 5,657,926 A | * | 8/1997 | Toda | 239/102.2 |
| 5,788,155 A | | 8/1998 | Martin et al. | |
| 5,823,428 A | | 10/1998 | Huberstone et al. | |
| 5,885,701 A | | 3/1999 | Berman et al. | |
| 5,894,841 A | | 4/1999 | Voges | |
| 5,915,377 A | | 6/1999 | Coffee | |
| 5,938,117 A | | 8/1999 | Ivri | |

* cited by examiner

*Primary Examiner*—Lisa Ann Douglas

(57) ABSTRACT

A liquid is held in a high viscosity solids suspension in a reservoir and is separated from the suspension by a capillary element which transfers the liquid to a vibrating orifice plate from which the liquid is ejected in the form of aerosolized liquid droplets.

7 Claims, 1 Drawing Sheet

METHOD AND APPARATUS FOR DISPENSING LIQUIDS IN AEROSOLIZED FORM WITH MINIMUM SPILLAGE

BACKGROUND OF THE INVENTION

1. Field of the Invention

This invention relates to the dispensing of liquids in the form of aerosolized liquid droplets and more particularly it concerns novel methods and apparatus for the aerosolized dispensing of liquids with a minimum of spillage.

2. Description of the Related Art

U.S. Pat. Nos. 5,164,740 and 5,938,117 show and describe devices for causing a liquid to be dispensed into the atmosphere in the form of minute liquid droplets. These devices comprise a thin orifice plate formed with minute orifices extending therethrough. The plate is vibrated at a high frequency while the liquid to be dispensed is maintained in contact with the underside of the plate. The vibratory movement of the plate causes the liquid to be pumped through the orifices in the plate and ejected into the atmosphere from its upper surface.

U.S. Pat. No. 5,518,179 shows a similar liquid dispenser wherein a capillary feed, such as a wick, is used to draw the liquid to be dispensed up from a reservoir to the lower surface of the vibrating plate.

Similar vibratory type liquid dispensers are shown and described in U.S. Pat. Nos. 4,790,479, 4,793,339, 5,518,179, 5,529,055 and 5,915,377.

It is also known to dispense vapors such as fragrances, air fresheners and other aromatics which are contained in a gell or in a solids suspension. Such vapor dispensing arrangements are shown and described in U.S. Pat. Nos. 5,419,879, 5,575,992, 5,637,401, 5,647,052, 5,788,155 and 5,885,701.

A problem is encountered when using a vibrating plate type dispenser to aerosolize certain low viscosity liquids such as liquid fragrances and liquid air fresheners. Such liquids easily pass through very minute orifices; and there is a tendency for the liquid to seep and leak out through mating surfaces in the dispenser assembly. There is also a danger of spillage when a refill reservoir is mounted in the dispenser assembly.

Although it is known to dispense some fragrances and aromatics from a gell or colloidal solid suspension, such fragrances and aromatics are evaporated from the solid suspension and are dispersed therefrom in the form of a vapor. It is not possible to dispense such fragrances and aromatics in the form of liquid droplets because the suspension is too thick or viscous to pass through the minute orifices of a liquid atomizing device such as a vibrating orifice plate.

SUMMARY OF THE INVENTION

This invention is based on the discovery that by providing a capillary element between a solids suspension and a vibrating orifice plate, the liquid component of the suspension becomes separated from the other material in the suspension whereby the liquid can be pumped through the plate orifices and dispersed into the atmosphere in the form of aerosolized droplets.

According to one aspect of the invention, there is provided a novel apparatus for generating aerosolized liquid droplets. This novel apparatus comprises an orifice plate formed with minute orifices extending therethrough in a given direction and a vibrator arranged to vibrate the orifice plate at high frequency in such given direction. A reservoir is located below the orifice plate and contains therein, a liquid to be aerosolized. The liquid is held in a solids suspension within the reservoir. A capillary element contacts the liquid within the reservoir and extends up out of the reservoir to the orifice plate. With this arrangement, the liquid is separated from the solids suspension and is pumped through the orifices in the plate and ejected into the atmosphere in the form of aerosolized liquid particles. Because the liquid is held in a solids suspension in the reservoir it has a high bulk viscosity and is not prone to leakage or spillage.

According to another aspect of the invention, there is provided a novel method of dispensing a liquid into the atmosphere in the form of minute aerosolized particles. This novel method comprises the steps of forming a solids suspension containing a liquid to be dispensed; and causing the liquid to be drawn up from the solids suspension through a capillary element to the lower surface of a vibrating orifice plate. The liquid becomes separated from the solids suspension and is pumped through minute orifices in the orifice plate and ejected into the atmosphere in the form of aerosolized particles.

DETAILED DESCRIPTION OF A PREFERRED EMBODIMENT

Figure 1:
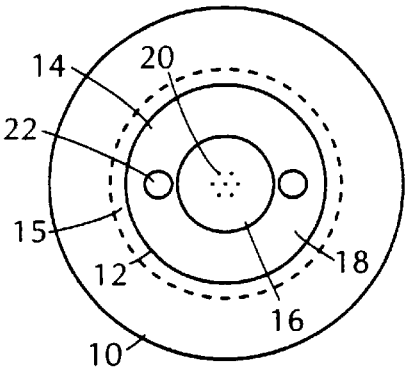
FIG. 1 is a plan view showing a vibrator atomizing device according to one embodiment of the invention.

The vibratory atomizing device of FIG. 1 comprises an annularly shaped piezoelectric actuator element 10 having an inner diameter center hole 12 and a circular orifice plate 14 which extends across the inner diameter hole 12 on the underside of the actuator and slightly overlaps an inner region 15 of the actuator. The orifice plate 14 is fixed to the underside of the actuator 10 in the overlap region 15. Any suitable cementing means may be used to fix the orifice plate 14 to the piezoelectric actuator element 10; however, in cases where the device may be used to atomize liquids which are corrosive, or aggressive in that they tend to soften certain cements, it is preferred that the orifice plate be soldered to the piezoelectric element. Also, the outer diameter of the orifice plate 14 may be as large as the outer diameter of the actuator element 10 so that it extends over the entire surface of one side of the actuator element. It should be understood that the orifice plate 14 may also be affixed to the upper side of the actuator 10.

The piezoelectric actuator element 10 may be made from any material having piezoelectric properties which cause it to change dimensionally in a direction perpendicular to the direction of an applied electric field. Thus, in the illustrated embodiment, the piezoelectric actuator element 10 should expand and contract in a radial direction when an alternating electrical field is applied across its upper and lower surfaces. The piezoelectric actuator element 10 may, for example, be a ceramic material made from a lead zirconate titanate (PZT) or lead metaniobate (PN). In the embodiment illustrated herein, the piezoelectric actuator element has an outer diameter of about 0.382 inches and a thickness of about 0.025 inches. The size of the center hole inner diameter is about 0.177 inches. These dimensions are not critical and they are given only by way of example. The actuator element 10 is coated on its upper and lower surfaces with an electrically conductive coating such as silver, nickel or aluminum to permit soldering of the orifice plate and electrical leads and to permit electric fields from the leads to be applied cross the actuator element.

The orifice plate 14 in the illustrated embodiment is about 0.250 inches in diameter and has a thickness of about 0.002 inches. The orifice plate 14 is formed with a slightly domed center region 16 and a surrounding flange region 18 which extends between the domed center region 16 and the region where the orifice plate is affixed to the actuator 10. The domed center region 16 has a diameter of about 0.103 inches and it extends out of the plane of the orifice plate by about 0.0065 inches. The domed center region contains several (for example 85) small orifices 20 which have a diameter of about 0.000236 inches and which are spaced from each other by about 0.005 inches. A pair of diametrically opposed larger holes 22 are fonned in the flange region 18. These holes have a diameter of about 0.029 inches and they allow liquid to flow freely therethrough. Again, the dimensions given herein are not critical and only serve to illustrate a particular embodiment. It should also be noted that while a domed orifice plate is described herein, orifice plates of other configurations may be employed, for example, orifice plates with shapes that resemble a convoluted or corrugated diaphragm.

It will be noted that the doming of the center region 16, which contains the orifices 20, increases its up and down movement of this region so as to improve the pumping and atomizing action of the orifice plate. While the domed center region is spherical in configuration, other configurations in this region may be used. For example, the center region 16 may have a parabolic or arcuate shape. Means other than doming may be used to stiffen the center region 16. For example, a support with spaced thickened elements, as shown in U.S. Pat. No. 5,152,456 may be used.

The orifice plate 14 is preferably made by electroforming with the orifices 20 and the holes 22 being formed in the electroforming process. However, the orifice plate may be made by other processes such as rolling; and the orifices and holes may be formed separately. For ease in manufacture, the center region 16 is domed after the orifices 20 have been formed in the orifice plate.

The orifice plate 14 is preferably made of nickel, although other materials may be used, provided that they have sufficient strength and flexibility to maintain the shape of the orifice plate while being subjected to flexing forces. Nickel-cobalt and nickel-palladium alloys may also be used.

The piezoelectric actuator element 10 may be supported in any suitable way which will hold it in a given position and yet not interfere with its vibration. Thus, the actuator element may be supported in a grommet type mounting (not shown).

Figure 2:
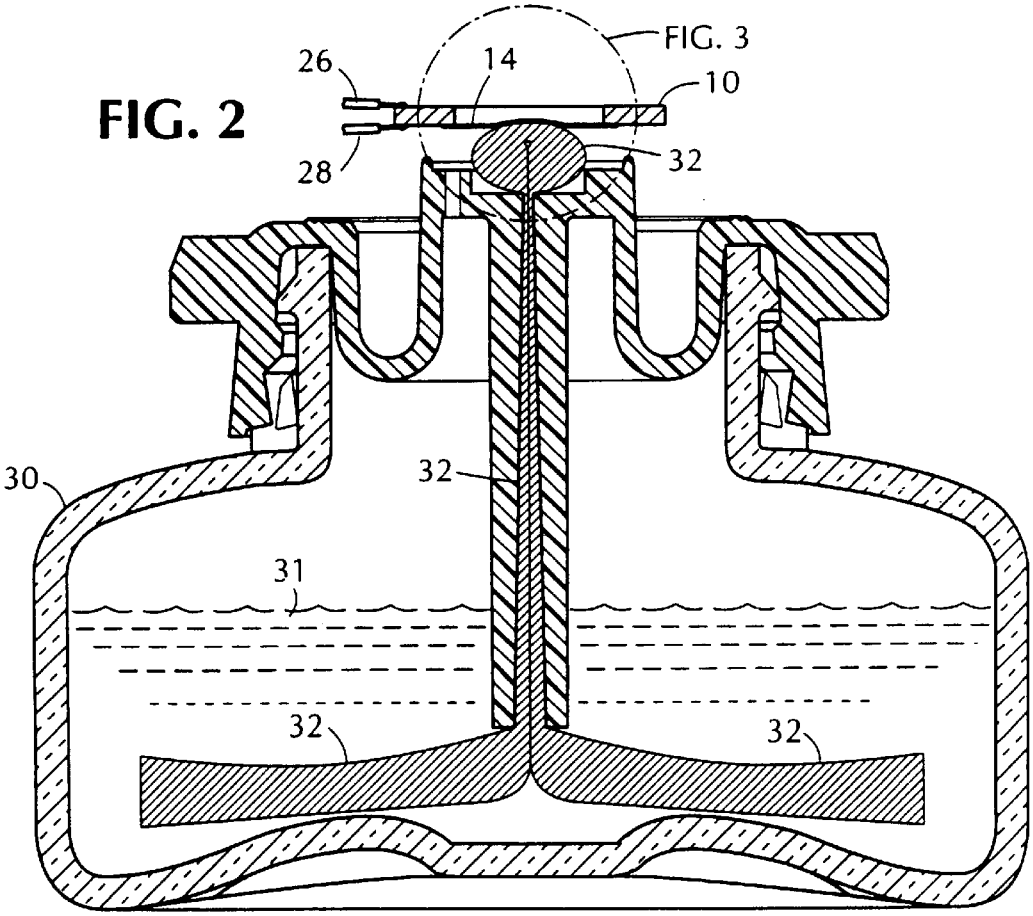
FIG. 2 is an elevational view of the vibrator atomizing device of FIG. 1 together with a reservoir for supplying liquid to the atomizing device.

The piezoelectric actuator element 10 is coated on its upper and lower surfaces with an electrically conductive coating such as silver, aluminum or nickel. As shown in FIG. 2, electrical leads 26 and 28 are soldered to the electrically conductive coatings on the upper and lower surfaces of the actuator element 10. These leads extend from a source of alternating voltages (not shown).

Figure 3:
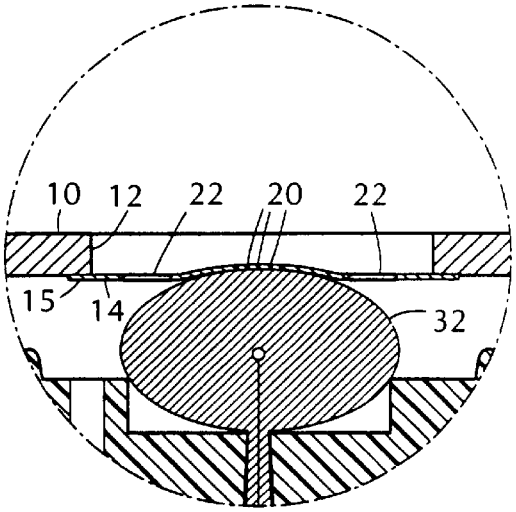
FIG. 3 is an enlarged fragmentary view of the region identified as FIG. 3 in FIG. 2.

A liquid reservoir 30 is mounted below the actuator element 10 and the orifice plate 14. The reservoir contains a solids suspension 31 which includes a liquid to be atomized. A wick 32 extends up from within the reservoir to the underside of the orifice plate 14 so that its upper end (where it is looped over and projects up from the reservoir) lightly touches the orifice plate in the center region 16 at the orifices 20. The upper end of the wick 32 also extends laterally so that it is directly under and is in direct liquid communication with the larger holes 22, as shown in FIG. 3. Actually, the wick could be annular and of a diameter larger than the domed center region 16.

The wick 32 may be made of a porous flexible material which provides good capillary action to the liquid in the reservoir 30 so as to cause the liquid to be pulled up to the underside of the orifice plate 14. At the same time the wick should be sufficiently flexible that it does not exert pressure against the orifice plate 14 which would interfere appreciably with its vibratory motion. Subject to these conditions, the wick 32 may be made of any of several materials, for example, paper, nylon, cotton, polypropylene, fiberglass, etc. A preferred form of wick 32 is strand of nylon chenille yam that is looped back on itself where it touches the orifice plate. This causes very thin fibers of the strand to extend up to the plate surface. These very thin fibers are capable of producing capillary action so as to bring liquid up to the orifice plate; however, these thin fibers do not exert any appreciable force on the plate which would interfere with its vibratory movement.

It will be appreciated that capillary type liquid conductor means other than a wick may be employed and the use of the word "wick" herein is intended to include such other capillary type liquid conductor means.

In operation of the atomizer, the wick 32 or other liquid conductor means, by means of capillary action, draws liquid 31 up from the reservoir 30 and into contact with the orifice plate 14 in the region of the atomizing orifices 20.

At the same time, alternating electrical voltages from an external source are applied through the leads 26 and 28 to the electrically conductive coatings on the upper and lower surfaces of the actuator element 10. This produces a piezoelectric effect in the material of the actuator element whereby the material expands and contracts in radial directions. As a result, the diameter of the center hole 12 increases and decreases in accordance with these alternating voltages. These changes in diameter are applied as radial forces on the orifice plate 14 and pushes its domed center region 16 up and down. This produces a pumping action on liquid which was drawn up against the underside plate 14 by the wick 32. The capillary action of the wick maintains the liquid on the underside of the orifice plate 14; and as a result, the liquid 31 is forced upwardly through the orifices 20 by the vibration of the plate and is ejected from the upper surface of the plate as finely divided aerosolized liquid particles into the atmosphere.

According to the present invention, the solids suspension 31 is made up of a liquid to be dispensed and a thickening agent which holds the liquid as a colloidal suspension. The liquid itself may be an air freshener comprising one or more volatile organic compounds. Such fragrance compounds are available from various perfumery suppliers, such as Firmenich Inc., Takasago, Inc., International Flavors and Fragrances, Inc., Quest, Inc. and Givaudan-Roure Corp. These fragrance compounds may be synthetically formed or they may be naturally derived oils such as oil of Bergamot, Bitter Orange, Lemon, Mandarin Caraway, Cedar Leaf, Clove Leaf, Cedar Wood, Geranium, Lavender, Orange, Origanum, Petitgrain, White Cedar, Patchouli, Lavindin, Neroli, Rose Absolute and the like. A wide variety of chemicals are used in perfumery, including aldehydes, ketones, esters, alcohols, terpenes and the like. A fragrance can be relatively simple in composition or it can comprise a complex mixture of natural and synthetic chemical components. A typical scented oil can comprise woody/earthy bases containing exotic constituents such as sandalwood oil, civit, patchouli oil and the like. A scented oil can have a light floral fragrance, such as rose extract or violet extract. Scented oil also can be formulated to provide desirable fruity odors, such as lime, lemon or orange.

Synthetic, types of fragrance compositions, either alone or in combination with natural oils are described in U.S. Pat. Nos. 4,314,915, 4,411,829 and 4,434,306, all of which are incorporated herein by reference. Other artificial fragrance compositions include geraniol, geranyl acetate, eugenol, isoeugenol, linalool, linalyl acetate, phenethyl alcohol, methylionone, isobornyl acetate and the like.

It is also within the scope of the present invention to dispense liquids other than fragrances. For example, liquid solvents or insecticides may also be dispensed in his manner.

The thickening agent which holds the liquid to be dispensed in suspension may be a fumed silica of the type marketed under the trademark Cab-O-Sil® by Cabot Corporation of Boston, Mass. It is expected that other silicas could also be used to produce the thickening effect. It appears that this thickening effect is achieved because the silica exhibits a hydrogen bonding effect between silica particles which holds the liquid fragrance in suspension. The silica, when throughly dispersed, forms a 3-dimensional matrix which holds the fragrance, insecticide or solvent formulation in suspension without increasing the liquid's own intrinsic viscosity. However, the overall mixture or matrix has a very high bulk viscosity which may be in excess of 750 centipoise. This high viscosity keeps the suspension in a very low flowable state so that it is not prone to spilling or leaking during handling of the reservoir. Another characteristic of the solids suspension is that it exhibits thixotropic properties in that the bulk viscosity decreases with shear stress. It is believed that this permits the liquid separation which is used in the practice of this invention.

By way of example, a formulation was prepared with 2% fumed silica (Cab-O-Sil®) and a fragrance liquid having a viscosity of 2.2 centipoise. After thoroughly dispersing the fumed silica in the fragrance, the bulk viscosity of the mixture was measured at 750 centipoise.

In spite of this very high viscosity, the vibrated orifice plate 14 was able to continuously and effectively produce and disperse extremely small aerosolized liquid droplets in a uniform manner over a period of about 30 days, after which the dispersal rate decreased significantly.

While it is not certain how the invention achieves liquid atomization from high bulk viscosity suspensions, it appears that the liquid fragrance portion becomes separated from the solids suspension at the wick 32, so that only the low viscosity liquid is fed to the vibrating orifice plate 14. This conclusion is based on the fact that following a decrease in the atomizing action, the reservoir 30 was observed to contain a gelled solid. In other words it appears that whereas the liquid portion of the mixture is drawn up through the wick 32 by capillary action, the silica portion separates and remains in the reservoir. It is also possible that at least some separation takes place in the region of the vibrating orifice plate 14 due to the thixotropic nature of the fragrance-silica mixture. In any event, in spite of the difficulty of atomizing liquids having a viscosity much greater than 10 centipoise in a battery driven vibrating orifice plate atomizer, it is nevertheless possible to achieve good atomization where the liquid is held in suspension in a mixture which has a bulk viscosity greater than 750 centipoise.

It has been found that the rate of atomization of liquids by battery driven orifice plate atomizers drops off rapidly for liquids whose viscosity exceeds 2.5 centipoise. Thus, even though a fragrance or other liquid can be atomized from a mixture whose bulk viscosity may exceed 750 centipoise, the viscosity of the liquid being atomized from the mixture should, itself have a viscosity not substantially greater than 2.5 centipoise.

The use of a liquid containing mixture having a high bulk viscosity permits handling and replacement of the reservoir 30 with minimum danger of spillage or leakage. In addition, because of the high viscosity of the mixture contained in the reservoir, the tendency of the liquid to spill or leak out from the reservoir is minimized. This is important in the case of insecticides and solvents because it minimizes toxicology concerns.

This invention also provides protection against the toxic effects of certain low viscosity liquids which may easily be aspirated by a person who may ingest the liquid, with the result that the aspirated liquid could cause significant lung damage, such as chemical pneumonitis. To provide sufficient bulk viscosity to protect against inadvertent aspiration, the bulk viscosity of the overall mixture should be greater than 100 saybolt universal seconds or about 20 centipoise.

INDUSTRIAL APPLICABILITY

This invention allows the effective dispensing of very low viscosity liquids through a vibrating orifice plate while protecting against leakage or spillage of the liquid. This is done by suspending the liquid in a very high viscosity solids suspension of fumed silica and causing the low viscosity liquid to be extracted from the suspension by a capillary action and transferred to the orifice plate.

What is claimed is:

1. A method of dispensing a liquid into the atmosphere in the form of minute aerosolized particles, said method comprising the steps of:

providing in a reservoir a solids suspension containing a liquid to be dispensed, said suspension in which said liquid is held having a high bulk viscosity to minimize the tendency of said liquid to spill or leak out of the reservoir during handling and replacement of the reservoir; and causing said liquid to be drawn up from said solids suspension through a capillary element to a lower surface of a vibrating orifice plate;

whereby said liquid is separated from said solids suspension and is pumped through minute orifices in said orifice plate and ejected into the atmosphere in the form of aerosolized particles.

2. Apparatus for generating aerosolized liquid droplets, said apparatus comprising:

an orifice plate formed with minute orifices extending therethrough in a given direction;

a vibrator arranged to vibrate said orifice plate at high frequency in said given direction;

a reservoir located below said orifice plate;

a liquid to be aerosolized, said liquid being held in a solids suspension within said reservoir, said suspension in which said liquid is held having a high bulk viscosity to minimize the tendency of said liquid to spill or leak out of the reservoir during handling and replacement of the reservoir; and a capillary element in contact with said liquid within said reservoir and extending up out of said reservoir to said orifice plate;

whereby said liquid is separated from said solids suspension and is pumped through said orifices and ejected into the atmosphere in the form of aerosolized liquid particles when said orifice plate is vibrated.

3. Apparatus according to claim 2, wherein said solids suspension is a matrix of fumed silica.

4. Apparatus according to claim 3, wherein said matrix is a colloidal suspension.

5. Apparatus according to claim 2, wherein said capillary element is a wick.

6. Apparatus according to claim 2, wherein said liquid has a viscosity not substantially greater than 2.5 centipoise.

7. Apparatus according to claim 2, wherein said suspension has a bulk viscosity of greater than 20 centipoise.

* * * * *